US011852111B1

(12) United States Patent
Dudar et al.

(10) Patent No.: US 11,852,111 B1
(45) Date of Patent: Dec. 26, 2023

(54) APPARATUS PREVENTING FUEL STARVATION ON INCLINED SURFACES

(71) Applicant: FORD GLOBAL TECHNOLOGIES, LLC, Dearborn, MI (US)

(72) Inventors: Aed M. Dudar, Canton, MI (US); Russell Randall Pearce, Ann Arbor, MI (US); Dennis Yang, Canton, MI (US); Paul Dreier, Livonia, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 17/900,545

(22) Filed: Aug. 31, 2022

(51) Int. Cl.
*F02M 37/00* (2006.01)
*F02M 37/02* (2006.01)

(52) U.S. Cl.
CPC .... *F02M 37/0017* (2013.01); *F02M 37/0082* (2013.01); *F02M 37/025* (2013.01)

(58) Field of Classification Search
CPC ..... F02M 37/0017; F02M 37/0076; F02M 37/0082; F02M 37/025
See application file for complete search history.

(56) References Cited

U.S. PATENT DOCUMENTS 2,905,327 A * 9/1959 Phillips ..... B01D 35/027 210/457
3,381,709 A * 5/1968 Pregno ..... B67D 7/062 137/578
4,428,835 A * 1/1984 Nagashima ..... B01D 29/19 210/220
4,717,477 A * 1/1988 Nagashima ..... B01D 35/02 210/232
4,773,260 A 9/1988 Ohno et al.
RE33,103 E * 10/1989 Nagashima ..... B01D 29/19 210/220
5,441,637 A * 8/1995 Gutjahr ..... B01D 35/0273 210/485

(Continued)

FOREIGN PATENT DOCUMENTS

CN 103485860 A * 1/2014 ..... F01M 11/06
DE 4127964 A1 * 10/1992

(Continued)

OTHER PUBLICATIONS

Photograph—2022 Jeep Wrangler Snorkel Pickup FDM; Sep. 2021.

*Primary Examiner* — John M Zaleskas
(74) *Attorney, Agent, or Firm* — Vincent Mastrogiacomo; Brooks Kushman P.C.

(57) ABSTRACT

An apparatus and a system are disclosed for preventing fuel starvation in an off-road vehicle that may be operated on a severely inclined surface. A vehicle having a fuel tank for a fuel delivery module disposed in the fuel tank. A fuel pump assembly is disposed in the fuel tank and a slip ring joint is assembled to the fuel delivery module. One or more tubes are assembled to the slip ring joint that extends and retracts relative to the slip ring joint toward and away from the walls of the fuel tank. A remote fuel pick-up is assembled to the tube so that when the vehicle is operated on an inclined surface, the remote fuel pick-up is extended and rotates inside the fuel tank to move toward and away from an inner surface of the fuel tank and follows the fuel contained in the fuel tank.

12 Claims, 4 Drawing Sheets

(56) References Cited

U.S. PATENT DOCUMENTS

| | | | | | |
|---|---|---|---|---|---|
| 6,000,913 | A * | 12/1999 | Chung | B60K 15/077 | 417/423.15 |
| 6,176,133 | B1 * | 1/2001 | Hutter | G01F 23/76 | 73/317 |
| 9,932,944 | B2 | 4/2018 | Yang et al. | | |
| 2004/0173266 | A1 * | 9/2004 | Burris | B67D 7/062 | 137/578 |
| 2010/0200204 | A1 * | 8/2010 | Chiba | B01D 19/0063 | 165/177 |
| 2011/0209789 | A1 * | 9/2011 | Murabayashi | F02M 37/0094 | 137/899 |
| 2013/0008524 | A1 * | 1/2013 | Murabayashi | F02M 37/0094 | 137/142 |
| 2017/0370336 | A1 * | 12/2017 | Pinault | F01M 11/064 | |

FOREIGN PATENT DOCUMENTS

| | | | | | |
|---|---|---|---|---|---|
| DE | 19927808 | A1 * | 12/2000 | F01M 11/06 | |
| DE | 202005003383 | U1 * | 6/2005 | F01M 1/02 | |
| DE | 102010024228 | A1 * | 12/2011 | F01M 11/0004 | |
| GB | 2350337 | A * | 11/2000 | B60K 15/077 | |
| JP | S6393626 | A * | 4/1988 | | |
| JP | 2011047232 | A * | 3/2011 | B60K 15/01 | |
| KR | 20040037931 | A * | 5/2004 | | |
| SE | 1651649 | A1 * | 6/2018 | F01M 11/0004 | |
| WO | WO-2008105723 | A1 * | 9/2008 | B60K 15/077 | |

* cited by examiner

APPARATUS PREVENTING FUEL STARVATION ON INCLINED SURFACES

TECHNICAL FIELD

This disclosure relates to fuel tanks for vehicles that are designed to be operated in extreme off-road conditions.

BACKGROUND

Vehicles designed for on-road travel may be designed so that when they are operated or parked on a 6% grade the fuel pump can always access the fuel in the fuel tank. Off-road vehicles are designed to climb extreme grades, on sand dunes, and over rocks or other objects that cause the vehicle to be oriented at greater angles of inclination than a 6% grade. Off-road vehicles are also operated over terrain that orients the vehicle at a compound angle (e.g. nose up and at a side angle or nose down and a side angle).

If a fuel pick-up is in an area where there is no fuel, the pickup will draw air, causing cavitation in the fuel pump. This phenomenon is referred to as "fuel starvation."

This disclosure is directed to solving the above problems and other problems as summarized below.

SUMMARY

According to a first aspect of this disclosure, an apparatus for preventing fuel starvation in vehicles operated on extreme grades and on compound angles. The apparatus includes a fuel tank and a fuel delivery module. The fuel tank has a bottom wall, a top wall, and a side wall connecting the bottom wall and the top wall that continuously extends around the periphery of the fuel tank. The fuel delivery module is disposed in the fuel tank and includes a fuel pump assembly and a remote fuel pick-up that is attached to a slip ring joint with a tube that is extendable and retractable. The slip ring joint is rotatable relative to the fuel delivery module. The tube and the remote fuel pick-up rotate with the slip ring joint, and the tube extends and retracts relative to the slip ring to follow the displaced fuel within the fuel tank caused by tilting the fuel tank of a vehicle.

According to a second aspect of this disclosure, a fuel tank apparatus is disclosed that minimizes fuel tank pick-up fuel starvation. The apparatus is for a vehicle that includes a fuel tank. The fuel tank has a plurality of walls enclosing a fuel delivery module and fuel pump assembly disposed in the fuel tank. A slip ring joint is assembled to the fuel delivery module and a tube is assembled to the slip ring joint. The slip ring joint extends and retracts relative to the slip ring joint and toward and away from the plurality of walls. A remote fuel pick-up is assembled to a distal end of the tube so that when the vehicle is operated on an inclined surface, the remote fuel pick-up is extended and rotated inside the fuel tank to move toward and away from an inner surface of the plurality of walls and thereby follow the fuel contained in the fuel tank as the fuel flows to a low area inside the fuel tank.

The first and second aspects of this disclosure may include additional optional aspects as provided below.

The apparatus may further comprise a second or multiple tubes attached to the slip ring joint, wherein the second tube is attached to the slip ring joint at a location spaced from the first tube and includes a second remote fuel pick-up assembled to the second tube.

The slip ring joint rotates may rotate about a Z axis and the tube and remote fuel pick-up move in a plane in the X axis and Y axis. As used herein, the Z axis is a vertical axis of the vehicle on a level surface and the X and Y axes are in a plane parallel to the level surface.

The slip ring joint may include internal passages that receive fuel from the tube and provide the fuel to a reservoir in the slip ring joint.

The apparatus may further comprise a weight member provided on the remote fuel pick-up to increase the effectiveness of a gravitational force applied to the remote fuel pick-up so that when the fuel tank is tilted, the remote fuel pick-up moves toward fuel in the fuel tank that also moves by gravity to a lowest area in the fuel tank.

The apparatus may further comprise a check valve provided in the fuel delivery module that limits the flow of fuel to flow from the from the remote fuel pick-up and the tube to the fuel delivery system.

According to a third aspect of this disclosure a system for drawing fuel in a fuel tank when a vehicle is operated on a severely inclined surface. The system includes a fuel tank having an inner surface, and a fuel delivery module disposed in the fuel tank. A slip ring joint is attached at a location to the fuel delivery module and a tube is connected to the slip ring joint. A fuel inlet nozzle is attached to a distal end of the tube so that when the fuel tank is moved by the vehicle on an inclined surface, the slip ring rotates the tube toward a low area of the fuel tank. The tube extends or retracts to move toward and away from the inner surface of the fuel tank in the low area of the fuel tank.

The third aspect of this disclosure may include additional optional aspects as described below.

The third aspect of this disclosure relates to a system that may further comprise a second tube attached to the slip ring joint that is attached to the slip ring joint at a location spaced from the first location and a second remote fuel pick-up assembled to the second tube.

The slip ring joint may rotate about a Z axis with the tube and remote fuel pick-up move in a plane in the X axis and Y axis.

The slip ring joint may include internal passages that receive fuel from the tube and provide the fuel to a reservoir in the slip ring joint.

The system may further comprise a weight member provided on the remote fuel pick-up to increase the effectiveness of a gravitational force applied to the remote fuel pick-up so that when the fuel tank is tilted, the remote fuel pick-up moves toward fuel in the fuel tank that also moves by gravity to a lowest area in the fuel tank.

The system may further comprise a check valve provided in the fuel delivery module that limits the flow of fuel to flow from the remote fuel pick-up and the tube.

The above aspects of this disclosure and other aspects will be described below with reference to the attached drawings.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Various features illustrated and described with reference to any one of the figures may be combined with features illustrated in one or more of the other figures to produce embodiments that are not explicitly illustrated or described. The combinations of features illustrated provide representative embodiments for typical applications. Various combinations and modifications of the features consistent with the teachings of this disclosure could be used in particular applications or implementations.

"One or more" includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof."

Figure 1:
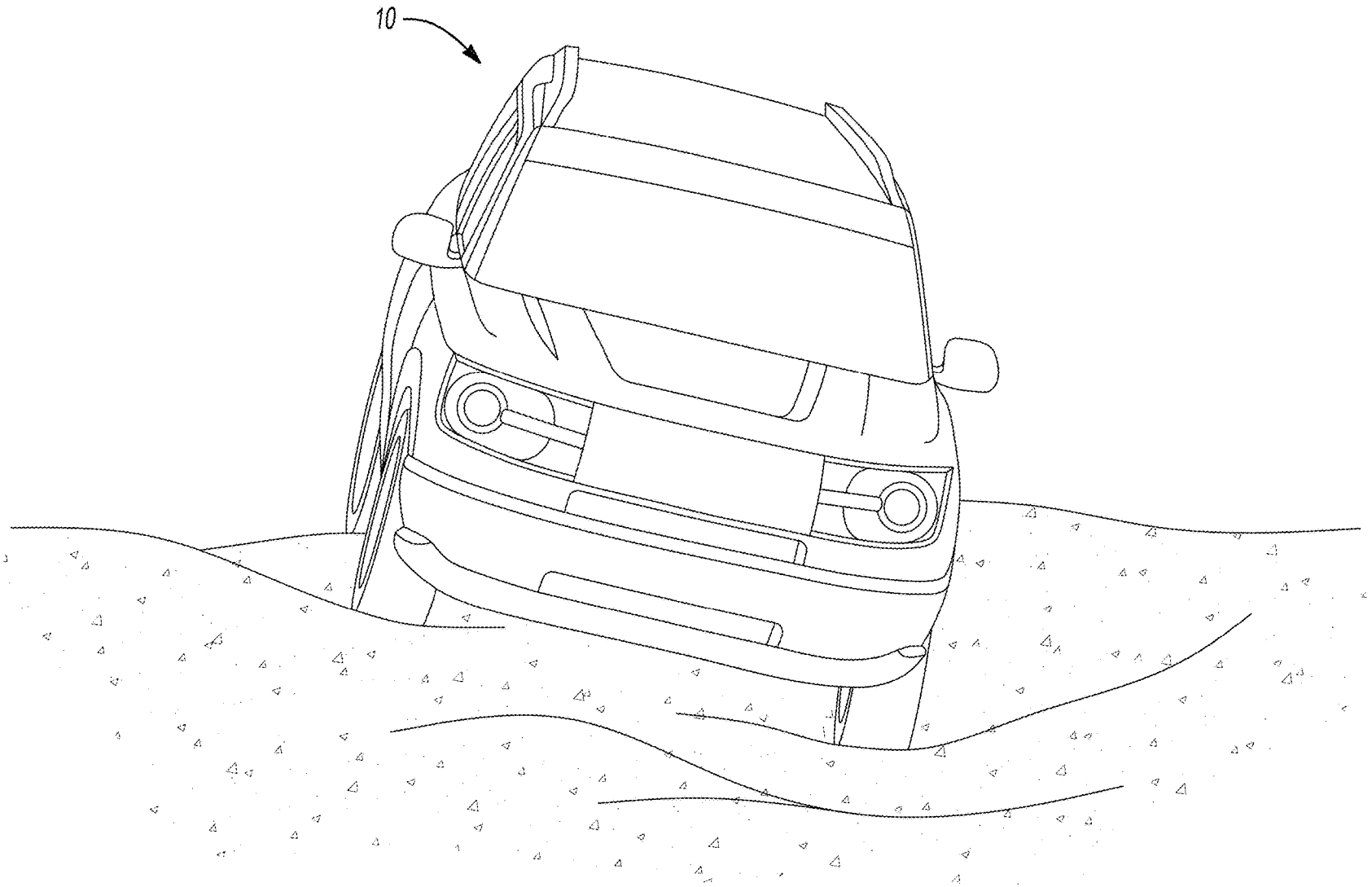
FIG. 1 is a perspective view of an off-road vehicle being operated on terrain having extreme grade that cause the vehicle to be oriented at greater angles of inclination that a 6% grade.

Referring to FIG. 1, an off-road vehicle 10 is shown driving over rough terrain that orients the vehicle at an extreme grade (e.g., more than 6% or on a compound angle).

Figure 2:
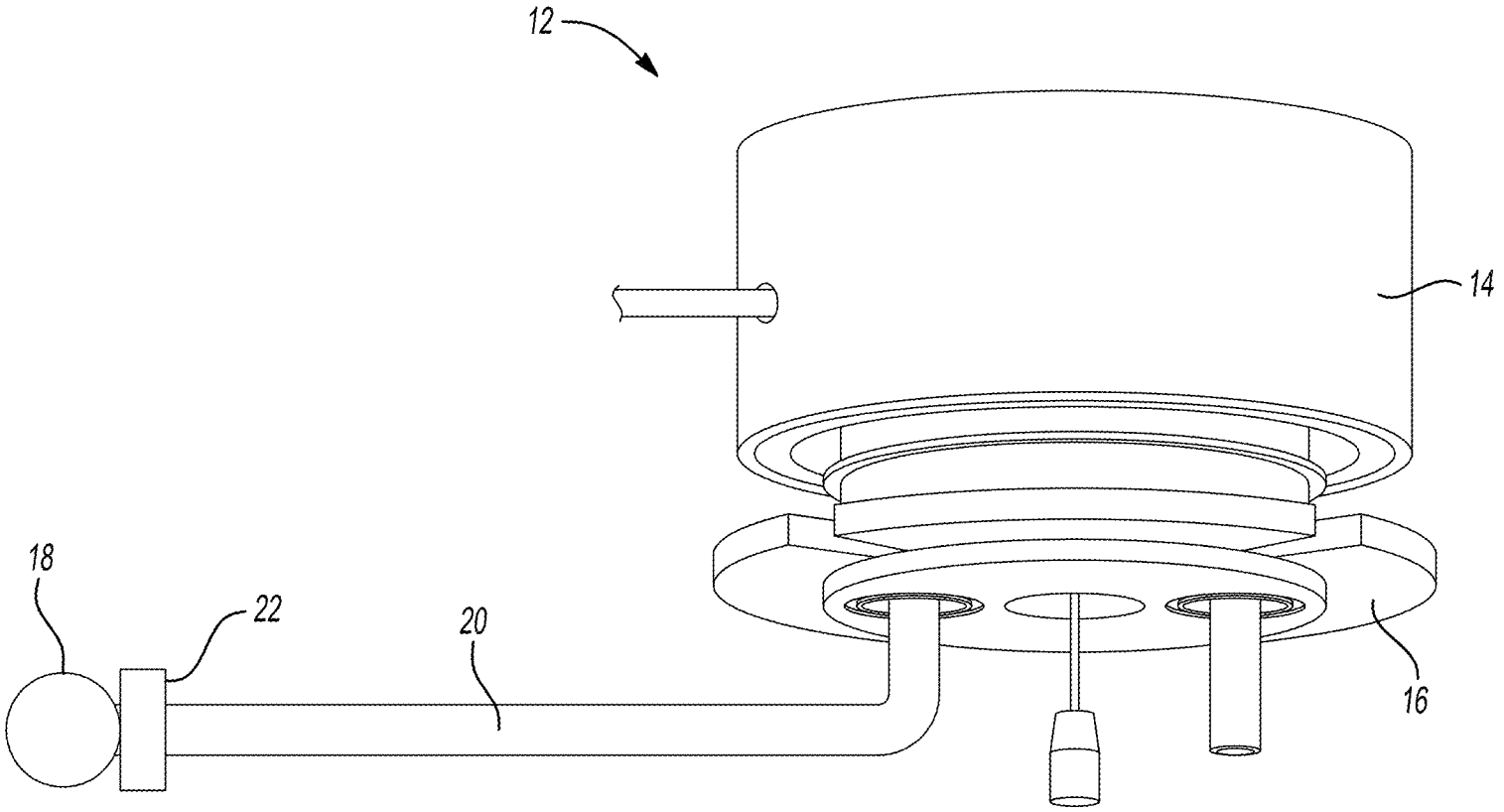
FIG. 2 is a perspective view of the fuel delivery module, the split ring joint, the tube and the remote fuel pick-up.

Referring to FIG. 2, one embodiment is illustrated of a slip ring joint 12 having a fixed portion 14 and a rotatable portion 16. A remote fuel pick-up 18 is attached to the rotatable portion 16 by a tube 20. The remote fuel pick-up as used herein refers to the pick-up being remote from the fuel pump and slip ring joint. The remote fuel pick-up 18, if too lightweight, has a weight member 22 that facilitates movement of the remote fuel pick-up 18 by the force of gravity. In the embodiment illustrated, only one remote fuel pick-up is shown but it should be understood that two or more remote fuel pick-ups could be provided. A single remote fuel pick-up is rotatable 360°. If two pick-ups are provided, they would only need to rotate 180°. While a single remote fuel pick-up is simpler, providing two or more remote fuel pick-ups reduces the range of movement and may be more effective in certain types of fuel tanks having unusual shapes.

Figure 3:
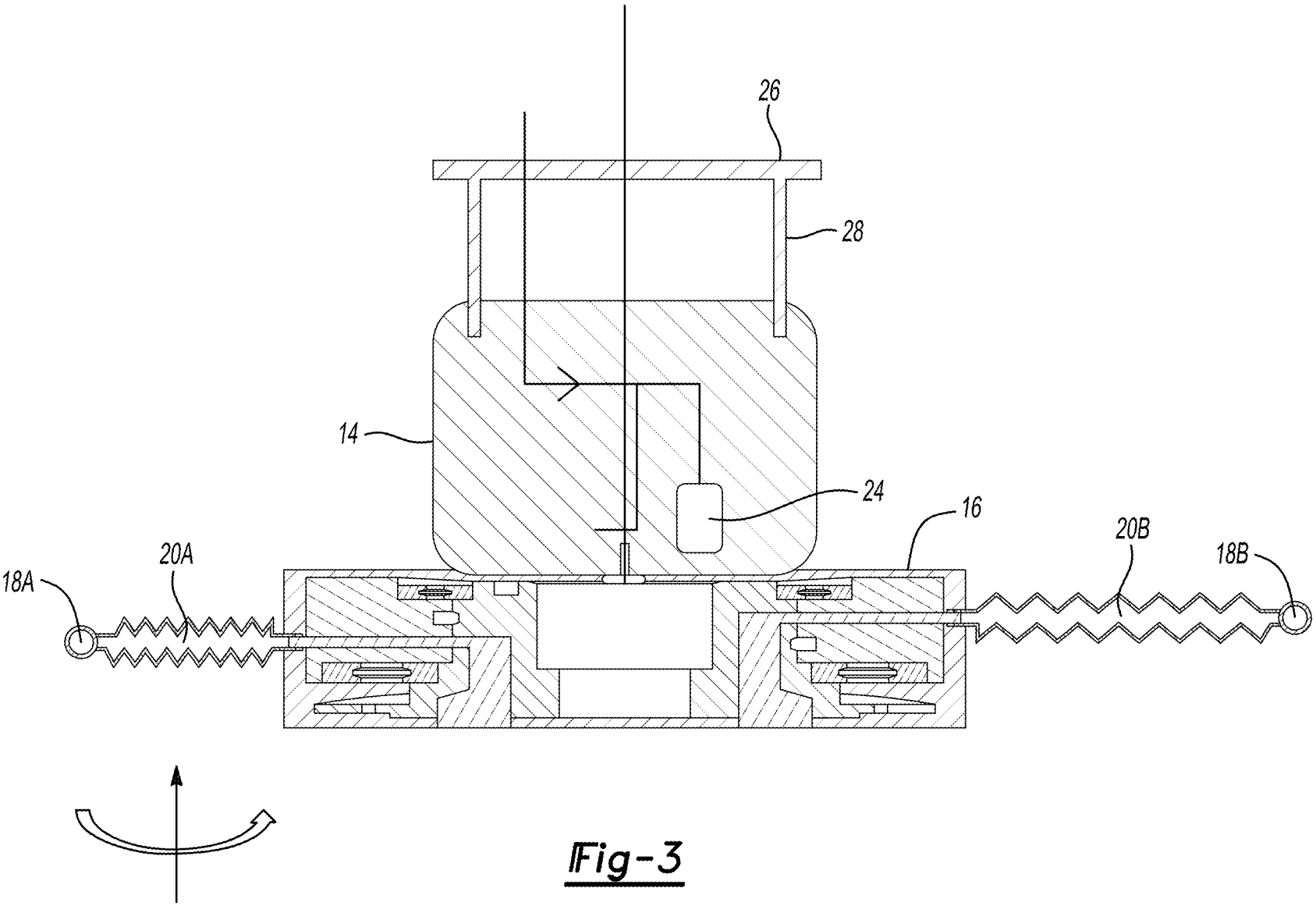
FIG. 3 is a cross-section view taken through the fuel delivery module, the split ring joint, the tube and the remote fuel pick-up.

Referring to FIG. 3, a fuel delivery module 23 includes two remote fuel pick-ups 18A and 18B connected by tubes 20A and 20B to the slip ring joint 12 and a fuel pump assembly 24. The fuel pump assembly 14 is attached inside a fuel tank 26 with a bracket 28.

Figure 4:
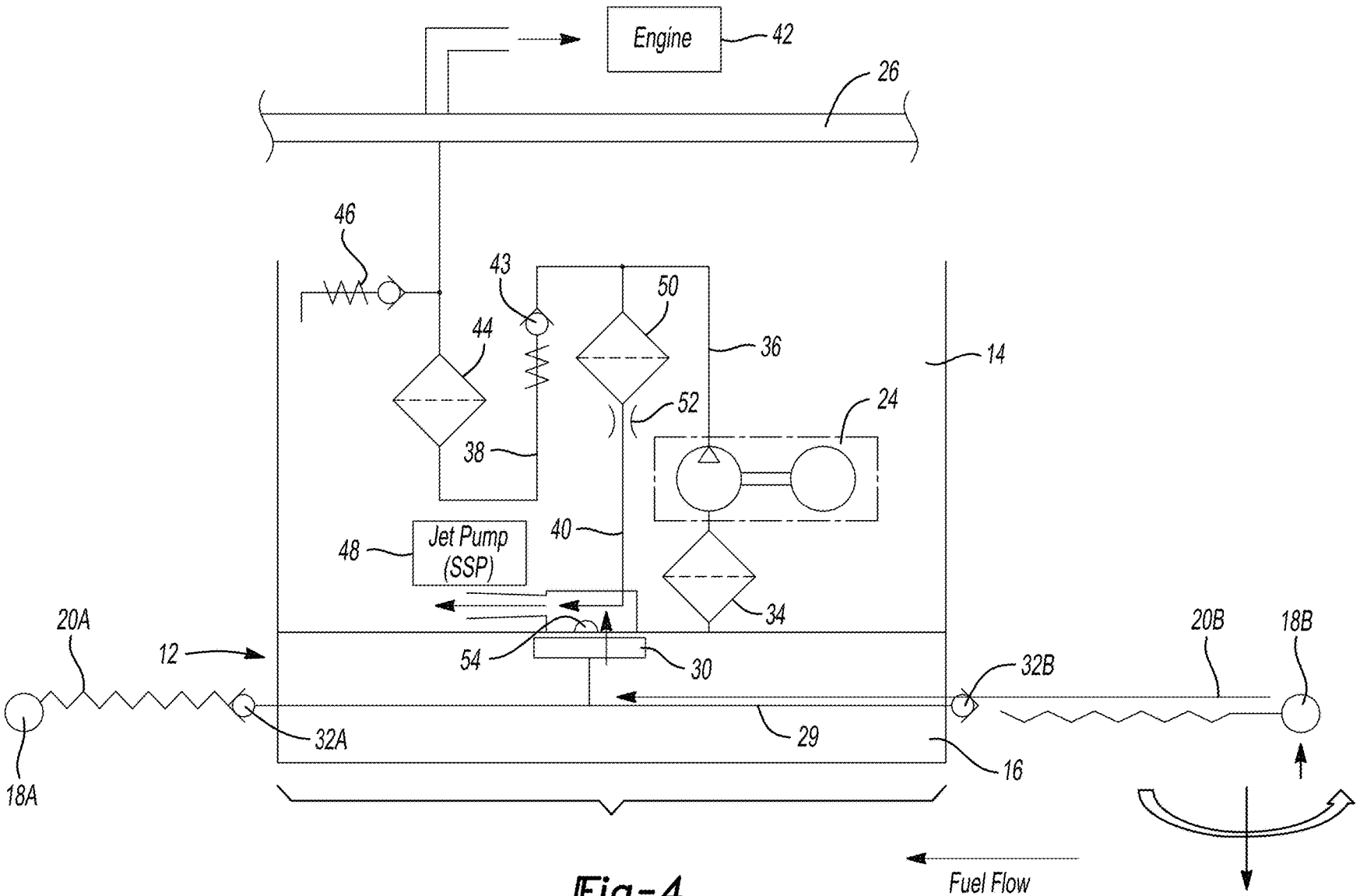
FIG. 4 is a schematic view of the fuel delivery system for a fuel tank of a vehicle.

Referring to FIG. 4, the flow of fuel in the system is described below beginning with fuel being drawn into the remote fuel pick-up(s). When the vehicle is on an inclined surface to fuel tank is held in a severe angle of inclination, the fuel will flow in a flow path from the remote fuel pick-up to the reservoir to the lowest point as a liquid being acted upon by gravity. Fuel that is displaced in the fuel tank to an area that is not accessible to a fuel pick-up may be referred to as "fugitive fuel" and may also be referred to as displaced fuel. In conventional fuel tank systems, a central fuel pick-up is disposed below the fuel pump assembly 24 and fugitive fuel in the fuel tank 26 is not accessible. In accordance with this disclosure, the remote fuel pick-up 18 is provided that follows the fugitive fuel in the lowest part of the fuel tank and draws fuel into the tube(s) 20.

The rotatable portion 16 of the slip ring joint 12 receives fuel from the remote fuel pick-up 18 and fuel passes through internal passages 29 of the rotatable portion 16 to a reservoir 30 in the rotatable portion 16. If two or more remote fuel pick-ups 18A and 18B are provided, check valves 32A and 32B to prevent air from being drawn into remote fuel pick-ups that are not submerged in the fugitive fuel in the fuel tank. If only one remote fuel pick-up is provided there is no need for a check valve at this location because the remote fuel pick-up should always be submerged in the lowest area inside the fuel tank 26.

The fuel pump assembly 24 receives fuel through a preliminary filter 34 and pumps fuel into a manifold 36 that includes an engine supply line 38 and a jet pump supply line 40. Fuel is pumped to the engine 42 through a check valve 43 and a fine filter 44. A pressure control 46 is provided to control the pressure in the manifold 36. Fuel is also pumped to a jet pump 48 through a choke 50 and a restriction 52. The jet pump flows fuel across an opening 54 in the reservoir and by venturi effect draws fuel into the fixed portion 14 of the slip ring joint 12.

The previous description of the apparatus disclosed, the disclosure also comprehends a system comprising a fuel tank for a vehicle and a fuel delivery module disposed in the fuel tank. A slip ring joint is assembled to the fuel delivery module and a tube is connected to a location on the slip ring joint. A remote fuel pick-up is attached to the tube that rotates to orient the tube toward a lower area of the fuel tank when the vehicle is on a severely inclined surface. The tube extends and retracts to move toward and away from the inner surface of the fuel tank in the lowest area of the fuel tank. Multiple tubes may be attached to the slip ring joint at locations spaced from the other tubes on the slip ring joint and multiple remote fuel pick-ups are assembled to all of the tubes.

In the system, the check valve is provided in a flow path from a system having multiple remote fuel pick-ups and tubes a reservoir that allows fuel to flow through the tube associated with the respective remote fuel pick-up but prevents entraining air from any remote fuel pick-up that is not submerged in the fuel. The slip ring joint includes internal passages that receive fuel from the tubes and provide the fuel to a reservoir in the slip ring joint.

The system may also include the use of a weight member on the remote fuel pick-up to increase the effectiveness of a gravitational force applied to the remote fuel pick-up to move with fuel in the fuel tank that also moves by gravity to a lowest area in the fuel tank.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An apparatus, comprising:

a fuel tank having a bottom wall, a top wall, and a side wall connecting the bottom wall and the top wall, wherein the side wall continuously extends around a periphery thereof;

a fuel pump assembly;

a fuel pick-up;

a slip ring joint;

a tube that is extendable or retractable, wherein the slip ring joint includes a rotatable portion and a fixed portion, wherein the rotatable portion is rotatable relative to the fixed portion that is fixed relative to the fuel tank, wherein the tube and the fuel pick-up are rotated in the fuel tank with the rotatable portion of the slip ring joint, and the tube extends or retracts relative to the rotatable portion of the slip ring joint to follow displaced fuel within the fuel tank caused by tilting the fuel tank;

a second tube attached to the slip ring joint, wherein the second tube is attached to the slip ring joint at a second location spaced from a location on the slip ring joint where the tube is attached, and a second fuel pick-up is assembled to the second tube;

a first check valve provided in a first flow path from the fuel pick-up to the fuel tank, wherein the first check valve allows fuel to flow through the tube and the fuel pick-up but prevents entraining air from the fuel pick-up when not submerged in the fuel; and a second check valve provided in a second flow path from the second fuel pick-up to the fuel tank, wherein the second check valve allows fuel to flow through the second tube and the second fuel pick-up but prevents entraining air from the second fuel pick-up when not submerged in the fuel.

2. The apparatus of claim 1 wherein the slip ring joint includes internal passages that receive fuel from the tube and provide the fuel to a reservoir in the slip ring joint.

3. The apparatus of claim 1 further comprising:

a weight member provided on the fuel pick-up to increase effectiveness of a gravitational force applied to the fuel pick-up, wherein when the fuel tank is tilted, the fuel pick-up moves toward fuel in the fuel tank that also moves by gravity to a lowest area in the fuel tank.

4. An apparatus, comprising:

a vehicle;

a fuel tank assembled to the vehicle, the fuel tank having a plurality of walls;

a fuel pump assembly disposed in the fuel tank;

a slip ring joint includes a rotatable portion and a fixed portion, wherein the fixed portion is fixed relative to the fuel tank;

a tube assembled to the rotatable portion of the slip ring joint at a first location, wherein the tube either extends or retracts relative to the slip ring joint and toward or away from the plurality of walls; and a first fuel pick-up assembled to the tube, wherein when the vehicle is operated on an inclined surface, the fuel pick-up is extended or retracted and rotated inside the fuel tank to move toward or away from an inner surface of the plurality of walls and thereby follow fuel contained in the fuel tank as the fuel flows to a lowest area inside the fuel tank.

5. The apparatus of claim 4 further comprising:

a second tube attached to the rotatable portion of the slip ring joint, wherein the second tube is attached to the rotatable portion of the slip ring joint at a second location spaced from the first location; and a second fuel pick-up assembled to the second tube.

6. The apparatus of claim 5 further comprising:

a first check valve provided in a first flow path from the first fuel pick-up to the fuel tank; and a second check valve provided in a second flow path from the second fuel pick-up to the fuel tank, wherein the first check valve and the second check valve allow fuel to flow through the first tube and the second tube, respectively, but prevent entraining air from the first fuel pick-up and the second fuel pick-up, respectively, when the first fuel pick-up and the second fuel pick-up are not submerged in the fuel.

7. The apparatus of claim 4 wherein the slip ring joint includes internal passages that receive fuel from the tube and provide the fuel to the fuel pump assembly.

8. The apparatus of claim 4 further comprising:

a weight member provided on the fuel pick-up to increase effectiveness of a gravitational force applied to the fuel pick-up in moving the fuel pick-up when the fuel tank is tilted, wherein the fuel pick-up moves toward fuel in the fuel tank that also moves by gravity to the lowest area in the fuel tank.

9. A system, comprising:

a fuel tank for a vehicle having a plurality of side walls that have an inner surface;

a slip ring joint including a fixed portion and a rotatable portion, wherein the fixed portion is fixed relative to the fuel tank;

a first tube connected to a first location on the rotatable portion of the slip ring joint; and a first fuel pick-up attached to the first tube, wherein when the fuel tank of the vehicle is on an inclined surface, the rotatable portion of the slip ring joint rotates to rotate the first tube toward a lowest area of the fuel tank, and wherein the first tube either extends or retracts to move either toward or away from the slip ring joint.

10. The system of claim 9 further comprising:

a second tube attached to the rotatable portion of the slip ring joint, wherein the second tube is attached to the rotatable portion of the slip ring joint at a second location spaced from the first location on the rotatable portion of the slip ring joint; and a second fuel pick-up assembled to the second tube.

11. The system of claim 9 further comprising:

a check valve provided in a flow path from the first fuel pick-up to the fuel tank that allows fuel to flow through the tube associated with the fuel pick-up but prevents entraining air from the fuel pick-up that is not submerged in the fuel.

12. The system of claim 9 further comprising:

a weight member provided on the fuel pick-up to increase the effectiveness of a gravitational force applied to the fuel pick-up to move with fuel in the fuel tank that also moves by gravity to the lowest area in the fuel tank.

* * * * *